US006174139B1

(12) United States Patent
Stölzer

(10) Patent No.: US 6,174,139 B1
(45) Date of Patent: Jan. 16, 2001

(54) AXIAL PISTON MACHINE WITH DAMPING ELEMENT FOR THE INCLINED OR WOBBLE PLATE

(75) Inventor: Rainer Stölzer, Neu-Ulm (DE)

(73) Assignee: Brueninghaus Hydromatik GmbH, Elchingen (DE)

( * ) Notice: Under 35 U.S.C. 154(b), the term of this patent shall be extended for 0 days.

(21) Appl. No.: 09/242,438

(22) PCT Filed: Oct. 1, 1997

(86) PCT No.: PCT/EP97/05396

§ 371 Date: Feb. 17, 1999

§ 102(e) Date: Feb. 17, 1999

(87) PCT Pub. No.: WO98/20258

PCT Pub. Date: May 14, 1998

(30) Foreign Application Priority Data

Nov. 5, 1996 (DE) ..... 196 45 580

(51) Int. Cl.[7] ..... F04B 1/26

(52) U.S. Cl. ..... 417/222.1; 91/506; 92/12.2

(58) Field of Search ..... 417/222.1; 91/504, 91/505, 506; 92/12.2, 82; 60/469, 487

(56) References Cited

U.S. PATENT DOCUMENTS

| | | | | |
|---|---|---|---|---|
| 2,299,235 | | 10/1942 | Snader et al. . | |
| 3,156,159 | * | 11/1964 | Cadiou | 91/506 |
| 3,784,328 | | 1/1974 | Pedersen | 91/506 |
| 4,690,036 | * | 9/1987 | Kosaka et al. | 91/506 |
| 4,896,506 | * | 1/1990 | Shivvers et al. | 91/506 |
| 5,794,515 | * | 8/1998 | Bethke | 91/506 |

FOREIGN PATENT DOCUMENTS

| | | | | |
|---|---|---|---|---|
| 2347542 | | 6/1973 | (DE) . | |
| 3428591 A1 | | 2/1986 | (DE) | 91/506 |
| 4440452 A1 | | 9/1995 | (DE) | 417/222.1 |
| 63-075366 | | 4/1988 | (JP) . | |
| 63-306287 | * | 12/1988 | (JP) | 417/222.1 |
| 4-350370 | | 12/1992 | (JP) . | |

* cited by examiner

*Primary Examiner*—Timothy S. Thorpe
*Assistant Examiner*—Cheryl J. Tyler
(74) *Attorney, Agent, or Firm*—Scully, Scott, Murphy & Presser

(57) ABSTRACT

An axial piston machine (1) which includes a cylinder block (2) having cylinder bores (3, 4) in which pistons (5, 6) are movably guided, with the pistons (5, 6) being supported on an inclined or wobble plate (25) in order to perform a lifting movement. The axial piston machine (1) further includes a pivot device (31) for varying the inclination of the inclined or wobble plate (25) by pivoting about a pivot axis (27). Provided is a damping element (41) which includes a damping piston (40) which acts on the inclined or wobble plate (25) and is movably disposed in a damping cylinder (42) which is connected to a pressure fluid reservoir (48) via a throttle element (47) and a non-return valve (44) is disposed parallel thereto. The non-return valve (44) enables pressure fluid to flow in an unthrottled manner from the pressure fluid reservoir (48) into the damping cylinder (42) and prevents the pressure fluid from flowing out of the damping cylinder (42) in an unthrottled manner by bypassing the throttle element (47). In this way, a damped pivoting movement of the inclined or wobble plate (25) is brought about.

9 Claims, 3 Drawing Sheets

AXIAL PISTON MACHINE WITH DAMPING ELEMENT FOR THE INCLINED OR WOBBLE PLATE

BACKGROUND OF THE INVENTION

1. Field of the Invention

The invention relates to an axial piston machine according to the preamble of claim 1 including a cylinder block having cylinder bores provided therein for the displaceable guidance of pistons so as to execute a lifting movement against an inclined or wobble plate. A pivoting device is adapted to change the inclination of the inclined or wobble plate by pivoting ht latter about a pivot axis.

2. Discussion of the Prior Art

An axial piston machine of this type is known for example, from DE 34 28 591 A1. In this axial piston machine, a plurality of cylinder bores, in which pistons are displaceably guided, are formed in known manner in a rotating cylinder block. The pistons are supported via slippers against a non-rotating inclined plate. The inclination of the inclined plate, which determines the displacement volume of the axial piston machine, is adjustable by means of a hydraulic adjusting piston, in that the inclined plate is pivotable through a given angle range about a pivot axis. When the inclined plate is pivoted back from the lift position in the direction of the zero lift position, the adjusting pressure acting upon the hydraulic adjusting piston is increased and the inclined plate pivots back until it reaches the zero lift position by abutting against an abutment surface. However, the movement of the inclined plate is relatively uncontrolled, so that the inclined plate strikes hard against the abutment surface upon reaching the zero lift position. This is undesirable, since it increases wear to the abutment and the inclined plate and also results in a mechanical impact loading of the entire axial piston machine.

Disclosed in DE 44 40 452 A1 is an axial piston machine with an inclined plate construction, in which two separate hydraulic cylinders are provided for the variation in the inclination of the inclined plate. In this respect, one of the hydraulic cylinders is used for pivoting the inclined plate outwards and the second hydraulic cylinder is used for pivoting the inclined plate back. Whilst the inclined plate is guided in a controlled manner during the entire movement sequence in this solution, the second hydraulic cylinder requires a comparatively large structural outlay, which results in relatively high manufacturing costs. Furthermore, a separate hydraulic control of both hydraulic cylinders is required.

SUMMARY OF THE INVENTION

It is therefore the object of the invention to further develop an axial piston machine having an inclined or wobble plate construction in such a manner that the movement sequence during the pivoting of the inclined or wobble plate is not effected abruptly but continuously.

The invention is based upon the knowledge that the pivoting back of the inclined or wobble plate can be controlled by providing a damping element acting upon the inclined or wobble plate. The damping piston is displaceably arranged in a damping cylinder, which is connected via a throttle element and a non-return valve arranged parallel to the throttle element to a pressure fluid reservoir. In this respect, the non-return valve allows for an unthrottled supply of the pressure fluid from the pressure fluid reservoir into the damping cylinder and prevents an unthrottled outflow of the pressure fluid from the damping cylinder bypassing the throttle element.

According to the invention, a restoring spring can act upon the damping piston in such a manner that the damping piston draws further pressure fluid out of the pressure fluid reservoir via the non-return valve and optionally via the throttle valve as soon as the damping piston is freely movable in the direction of an increase in volume of the damping cylinder. In this manner, it is ensured that the damping cylinder is instantaneously refilled with pressure fluid and therefore that the pivoting movement of the inclined or wobble plate occurs directly. According to an inventive aspect, the pressure medium reservoir can be a leakage fluid collecting chamber surrounding the damping element, the leakage fluid collecting chamber usually being formed by the housing interior of the axial piston machine.

According to a further feature, the inclined or wobble plate can have a first pivot position with a larger angle of inclination and a second pivot position with a smaller angle of inclination and can be pivoted back and forth between these two pivot positions. According to invention, the axial piston machine can also be designed with an inclined plate construction, it being possible to arrange the damping element in the inclined plate or in a stationary counter element opposing the inclined plate according to FIG. 9. In this respect, the restoring spring holds the damping piston in abutment against the inclined plate or against the stationary counter element.

According to the invention, the inclined plate can also comprise a first and a second abutment surface on its side facing away from the pistons, the abutment surfaces each forming an abutment for the first and second pivot position of the inclined plate.

According to another feature, it is particularly advantageous to offset the point of application, at which the damping piston acts upon the inclined plate, relative to the cylinder block axis in such a manner that the resulting force, which is composed of the force exerted by the damping piston upon the inclined plate, the force exerted by the pivoting device upon the inclined plate during the pivoting procedure and the force exerted by the pistons upon the inclined plate, acts at a center of gravity of the forces which is located on the cylinder block axis. In this manner, non-symmetrical bearing forces are prevented and a levering-out of the bearing is avoided.

BRIEF DESCRIPTION OF THE DRAWINGS

The invention will be described in further detail in the following with the aid of preferred embodiments with reference to the drawings, in which.

DETAILED DESCRIPTION OF PREFERRED EMBODIMENTS

Figure 1:
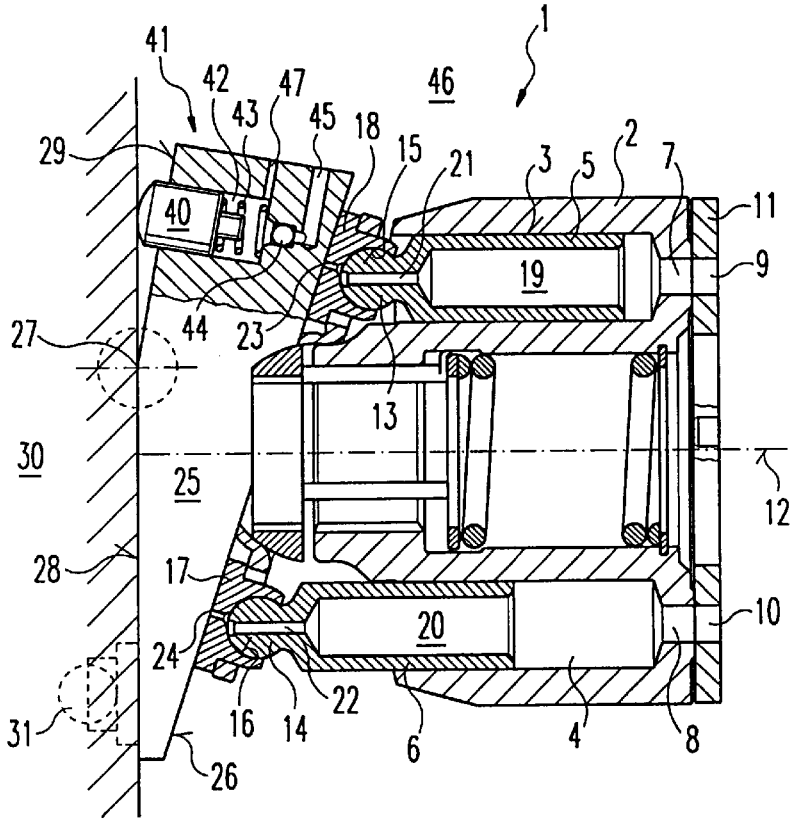
FIG. 1 is a partial axial section through a first embodiment of the axial piston machine further developed according to the invention in a first pivot position of the inclined plate.
Figure 2:
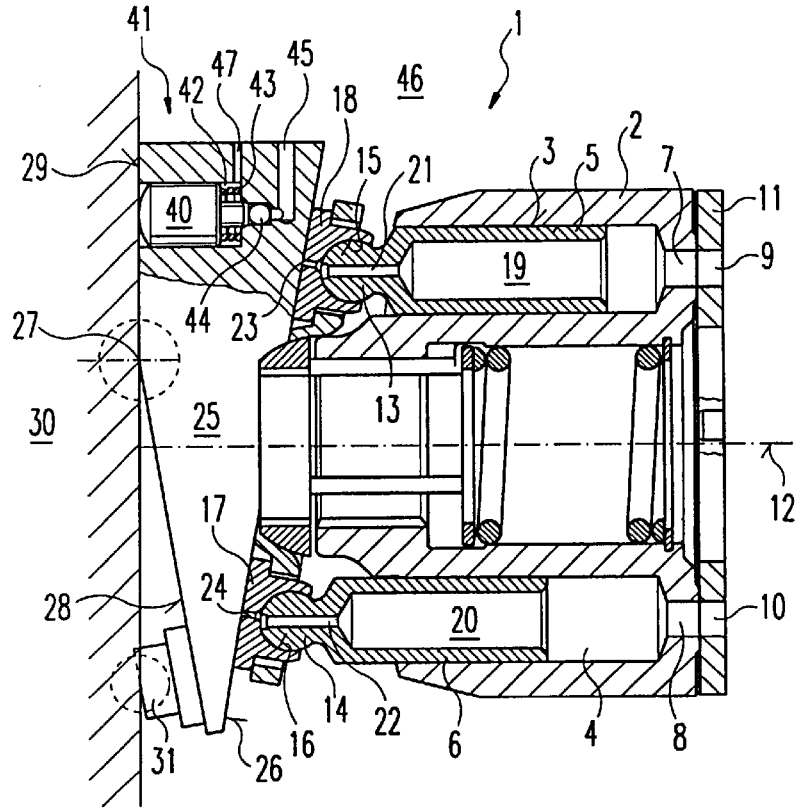
FIG. 2 shows the first embodiment illustrated in FIG. 1 of the axial piston machine further developed according to the invention in a second pivot position of the inclined plate.

FIG. 1 and FIG. 2 are axial longitudinal sections through an only partially illustrated axial piston machine 1 further developed according to the invention. The axial piston machine 1 illustrated by way of example in FIG. 1 and FIG. 2 is designed with an inclined plate construction and comprises a cylinder block 2, in which a plurality of cylinder bores 3, 4 are provided, which are arranged uniformly distributed over a graduated circle. Displaceably arranged in the cylinder bores 3, 4 are pistons 5, 6. The cylinder bores 3, 4 are connected via connecting ducts 7, 8 to the kidney-shaped control apertures 9, 10 of a stationary control disc 11. The cylinder block 2 rotates about the cylinder block axis 12, so that the cylinder bores 3, 4 are cyclically connected to a low pressure line, not shown, which is connected to the control aperture 9, and a high pressure line, not shown, which is connected to the control aperture 10. The pistons 5, 6 are molded at their ends remote from the control disc 11 to form spherical heads 13, 14, which are mounted in spherical bearings 15, 16 of slippers 17, 18 associated with the pistons 5, 6. The pistons 5, 6 are constructed as hollow pistons and each comprise a piston recess 19, 20. For hydrostatic relief, the piston recesses 19, 20 are connected via connecting ducts 21, 22 of the pistons 5, 6 and also via connecting ducts 23, 24 of the slippers 17, 18 to push-buttons provided on the slippers 17, 18.

The pistons 5, 6 are supported via the slippers 17, 18 against a slide surface 26 of the inclined plate 25. The inclined plate 25 is mounted so as to pivot about a pivot axis 27 and on its side facing away from the pistons 5, 6 comprises a first abutment surface 28 and a second abutment surface 29. When the inclined plate rests with its first abutment surface 28 against a stationary counter element 30, as shown in FIG. 1, the inclined plate or its slide surface 26 is inclined relative to the cylinder block axis 12 with a first, relatively large angle of inclination. In contrast, when the inclined plate rests with its second abutment surface 29 against the stationary counter element 30, as shown in FIG. 2, the inclined plate or its slide surface 26 is inclined relative to the cylinder block axis 12 with a second angle of inclination, which is smaller than the first angle of inclination. In the embodiment, the inclination of the inclined plate 25 can therefore be pivoted back and forth between two distinct pivot positions by means of a pivoting device 31, only schematically indicated. The pivoting device 31 can comprise a hydraulically actuated adjusting piston, for example, which acts upon the inclined plate 25 in a force-locking manner.

According to the invention, the damping piston 40 of a damping element generally designated by the reference 41 also acts upon the inclined plate 25. In the embodiment illustrated in FIGS. 1 and 2, the damping element 41 is integrated in the inclined plate 25. The damping piston 40 is displaceably arranged in a damping cylinder 42 provided in the inclined plate 25 in the embodiment of FIGS. 1 and 2. The damping cylinder 42 is constructed as a blind bore, which opens onto the second abutment surface 29 of the inclined plate 25. The damping piston 40 is brought into abutment against the stationary counter element 30 by means of a restoring spring 43 also arranged in the damping cylinder 42. The stationary counter element 30 can be a housing end plate, for example. The damping cylinder 42 is connected via a non-return valve 44 and a supply duct 45 to the housing interior 46, which encloses the inclined plate 25 and the cylinder block 2, acts as a leakage fluid collecting chamber and is accordingly filled with leakage fluid. The damping cylinder 42 is additionally connected via a throttle element 47 to the housing interior 46 of the axial piston machine 1. In the illustrated embodiment, the throttle element 47 is constructed as a bore with a relatively small cross section. The supply duct 45 and the non-return valve 44 are thus arranged parallel to the throttle element 47.

The damping element 41 according to the invention operates as follows:

When the inclined plate 25 is pivoted from the second pivot position illustrated in FIG. 2 in the direction of the first pivot position illustrated in FIG. 1 as a result of a relief of the pivoting device 31, then the damping piston 40 is brought into abutment against the stationary counter element 30 by means of the restoring spring 43. During this procedure, pressure fluid is drawn via the supply duct 45 and the opened non-return valve 44 and parallel via the throttle element 47 out of the housing interior 46 filled with leakage fluid. The filling of the damping cylinder 42 is effected via the supply duct 45 and the non-return valve 44 so speedily that the damping piston 40 is held in continuous abutment against the stationary counter element 30.

Conversely, when the pivot plate 25 is pivoted from the first pivot position illustrated in FIG. 1 into the second pivot position illustrated in FIG. 2 as a result of actuation by means of the pivoting device 31, the non-return valve 44 closes the supply duct 45 and the pressure fluid located in the damping cylinder 42 can only flow out of the damping cylinder 42 via the throttle element 47. In this manner, the desired damping is attained and the pivoting movement of the inclined plate 25 is prevented from occurring abruptly so that the abutment surface 29 strikes sharply against the stationary counter element 30. This would result in relatively rapid wear of the pivot plate 25 and the stationary counter element 30. In addition, the entire axial piston machine 1 would be subjected to impact loading during this pivoting movement, which is undesirable.

As a result of the damping element 41 provided according to the invention, the pivoting procedure is therefore slightly delayed and a continuous, non-abrupt pivoting movement of the inclined plate 25 is attained. Furthermore, in the second pivot position illustrated in FIG. 2 and during pivoting from the first pivot position illustrated in FIG. 1 into the second pivot position illustrated in FIG. 2, the damping element 41 according to the invention ensures a certain degree of support of the section of the inclined plate 25 disposed above the pivot axis 27, so that the loading to which the inclined plate 25 is subjected is advantageously reduced by the further development according to the invention.

Figure 3:
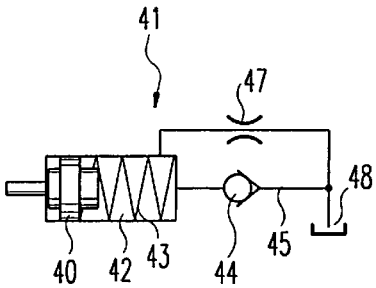
FIG. 3 is a schematic illustration of the method of operation of the damping element.

FIG. 3 illustrates the method of operation of the damping element 41 according to the invention by way of a hydraulic equivalent circuit diagram. Elements which have already been described are provided with corresponding reference numerals in order to facilitate the allocation of numerals. As already described, the suction of pressure fluid from a pressure fluid reservoir 48, which can be the housing interior 46, for example, is effected via the supply duct 45 and the non-return valve 44 arranged between the supply duct 45 and the damping cylinder 42. Arranged parallel to the non-return valve 44 and the supply duct 45 is the throttle element 47, which ensures a throttled outflow of the pressure fluid from the pressure fluid cylinder 42 into the pressure fluid reservoir 48 with the non-return valve 44 closed.

Figure 4A:
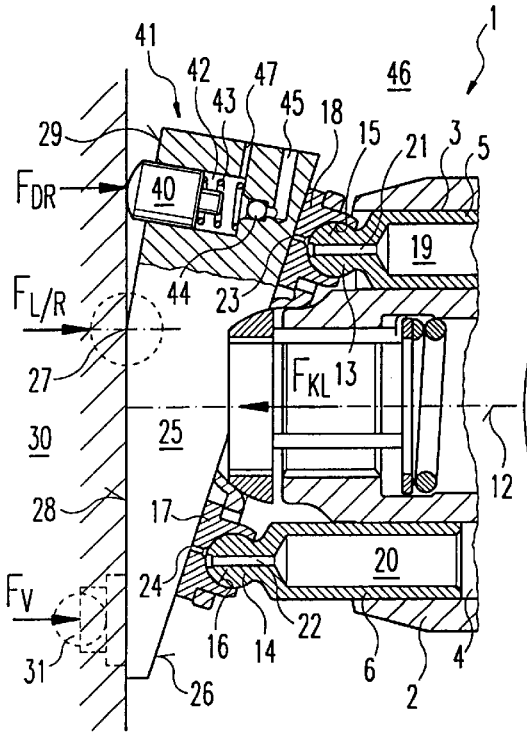
FIG. 4A shows the force distribution in the embodiment illustrated in FIG. 1 of the axial piston machine further developed according to the invention.
Figure 4B:
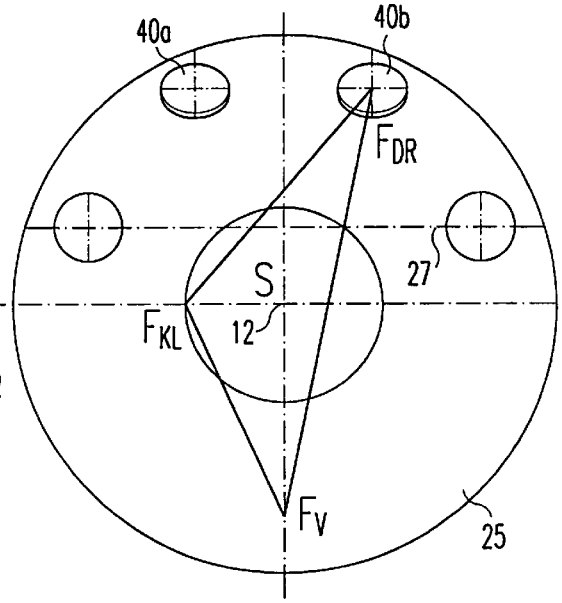
FIG. 4B is a side view of the illustration according to FIG. 4A.
Figure 4C:
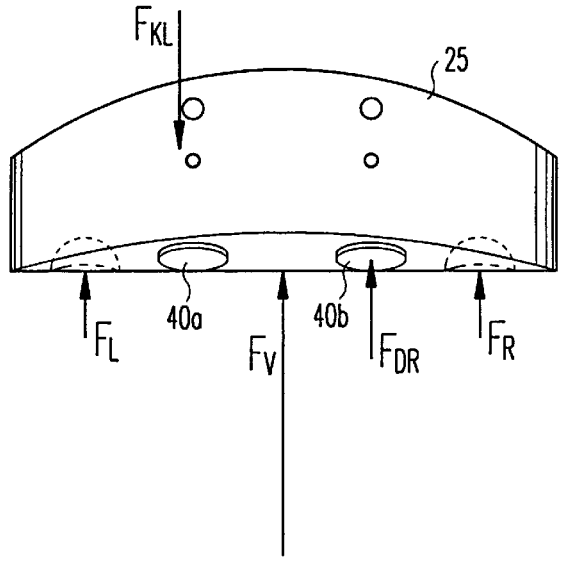
FIG. 4C is a plan view of the illustration according to FIG. 4A.

FIGS. 4A to 4C illustrate the distribution of forces in the axial piston machine 1 according to the invention according to the embodiment already explained with the aid of FIGS. 1 and 2. In this respect, FIG. 4A is a drawing corresponding to FIG. 1, whilst FIG. 4B is a side view in the direction of the side of the inclined plate 25 facing away from the pistons 5, 6 and FIG. 4C is a plan view of the arrangement illustrated in FIG. 4A.

As shown in FIGS. 4A to 4C, the inclined plate 25, as it is adjusted, is acted upon by the force component $F_V$ exerted by the pivoting device 31, the bearing force $F_{L/R}$ exerted upon the bearing of the pivot axis 27, the force $F_{DR}$ exerted by the damping pistons 40*a* and 40*b*, of which there are two in the embodiment, and the force $F_{KL}$ exerted in the opposite direction by the pistons 5, 6. In this respect, it is particularly advantageous if the point of application, at which the respective damping piston 40*b* or 40*a* acting on the right or left acts upon the inclined plate 25, is offset relative to the cylinder block axis in such a manner that the resulting force, composed of the force $F_{DR}$ exerted by the corresponding damping piston 40*b* or 40*a* upon the inclined plate 25, the force $F_V$ exerted by the pivoting device 31 upon the inclined plate 25 during the pivoting procedure and the force $F_{KL}$ exerted by the pistons 5, 6 upon the inclined plate 25, acts at a centre of gravity of the forces (S) which is located on the cylinder block axis 12. In this manner, a symmetrical distribution of the bearing forces acting upon the bearing of the cylinder block 2 is attained and products of inertia are prevented. In this manner, a levering-out of the bearing of the cylinder block 2 is counteracted. A force triangle according to FIG. 4B could also be drawn for the left-hand damping piston 40*a*, which is omitted for the sake of simplification.

Figure 5:
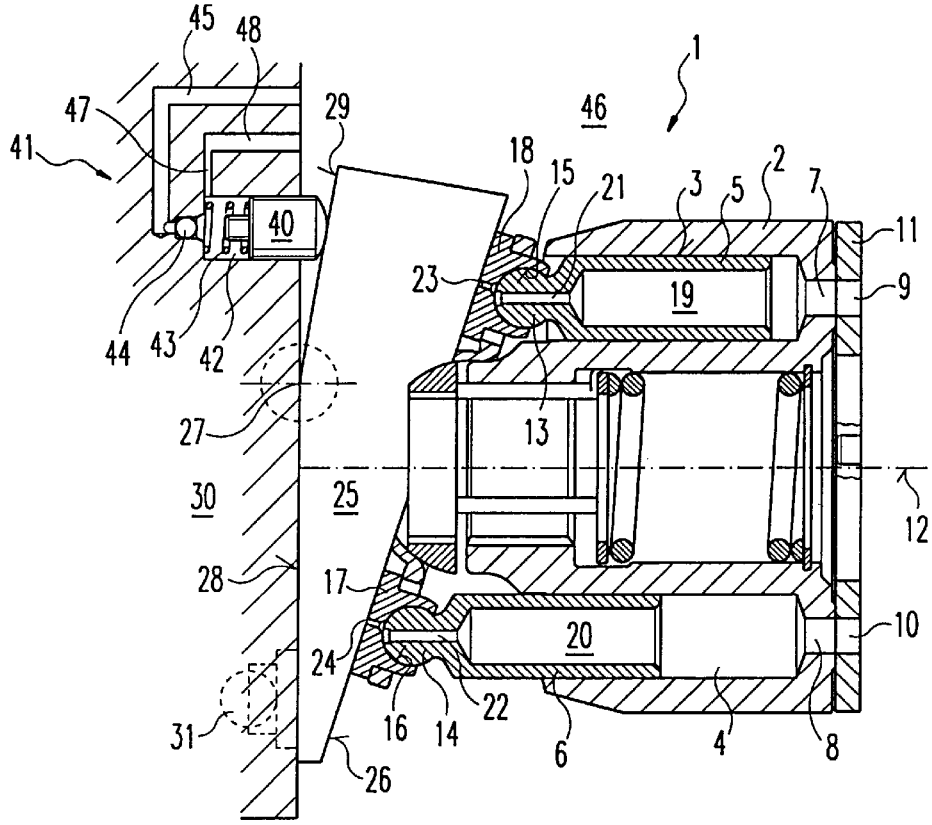
FIG. 5 is a partial axial section through a second embodiment of the axial piston machine further developed according to the invention in a second pivot position of the inclined plate.
Figure 6:
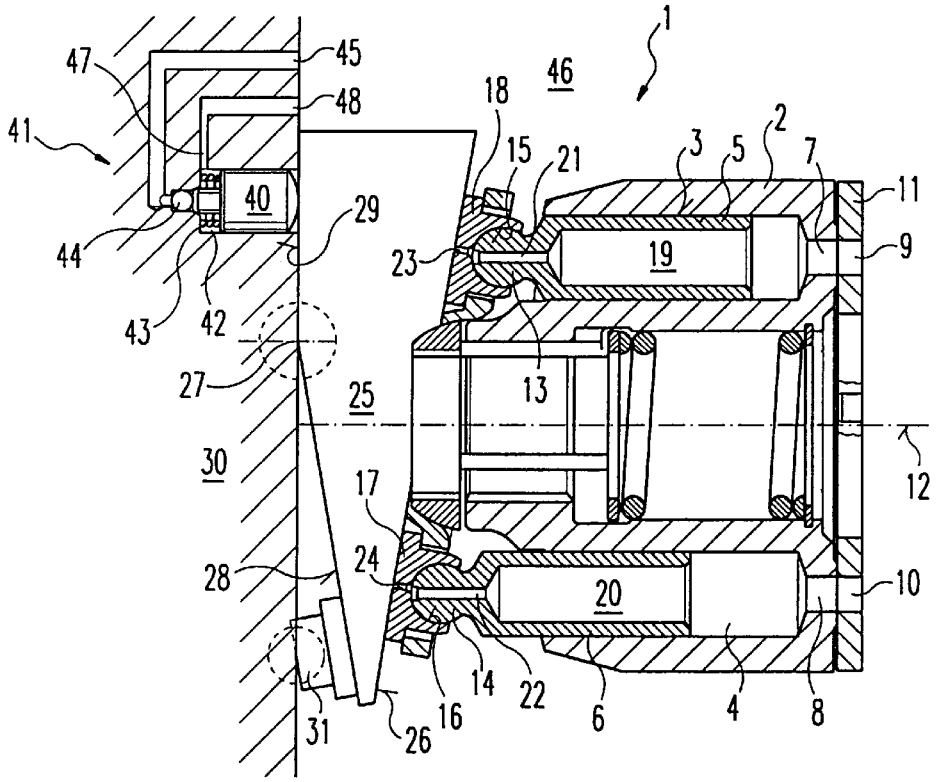
FIG. 6 shows the second embodiment illustrated in FIG. 5 of the axial piston machine further developed according to the invention in a second pivot position of the inclined plate.

FIGS. 5 and 6 are axial longitudinal sections through a second embodiment of an axial piston machine 1 further developed according to the invention. Already-described elements are provided with corresponding reference numerals, so that a repeat description of said elements is unnecessary.

The embodiment illustrated in FIGS. 5 and 6 differs from the embodiment illustrated in FIGS. 1 and 2 in that the damping element 41 according to the invention is not arranged in the inclined plate 25, but on the stationary counter element 30 lying opposite the inclined plate 25, i.e. in a housing end plate. The damping element 41 has essentially the structure already described with the aid of FIG. 1. The damping piston 40 is displaceably arranged in the damping cylinder 42 and is acted upon by means of the restoring spring 43 in such a manner that the damping piston 40 rests against the inclined plate 25, preferably against the second abutment surface 29. The drawing of the pressure fluid from the housing interior 46 is effected via the supply duct 45 and the non-return valve 44, which is open in the suction phase. When the inclined plate 25 is pivoted from the first pivot position illustrated in FIG. 5 into the second pivot position illustrated in FIG. 6, the pressure fluid is forced out of the damping cylinder 47 via the throttle element 47, also constructed in this embodiment as a bore with reduced diameter, and via the outflow duct 48 connected thereto, so that the intended damping of the movement of the inclined plate 25 and the support of the inclined plate 25 during the pivoting is effected.

The invention is not limited to the illustrated embodiments. As already mentioned, the present invention can also be used in axial piston machines having a wobble plate construction. The damping arrangement can also be arranged at any other desired location, provided that it is ensured that the damping piston 40 acts in an appropriate manner upon the inclined plate 25 or wobble plate. Furthermore, additional damping elements can be provided in the region of the first abutment surface 28 in order to also ensure sufficient damping for the other pivoting device.

What is claimed is:

1. An axial piston machine (1) including a cylinder block (2) having cylinder bores (3, 4) formed therein; pistons (5, 6) being displaceably guided within said cylinder bores, said pistons (5,6) being rotatable about an axis (12) of the cylinder block in order to execute a lifting movement while supported against an inclined plate (25); a pivoting device (31) for changing the inclination of the inclined plate (25) by pivoting said plate about a pivot axis (27); at least one damping element (41) being arranged in the inclined plate (25) and including at least one damping piston (40), which acts upon the inclined plate (25) and is displaceabley arranged in a damping cylinder (42), the damping cylinder being connected to a pressure fluid reservoir (48) via a throttle element (47) and a non-return valve (44) arranged in parallel to the throttle element (47), said non-return valve (44) facilitating an unthrottled supply of the pressure fluid from the pressure fluid reservoir (48) into the damping cylinder (42) and preventing an unthrottled outflow of fluid so that the pressure fluid which is located in the damping cylinder (42) is restricted to flowing out of the damping cylinder via the throttle element (47).

2. An axial piston machine according to claim 1, wherein a restoring spring (43) is arranged in the damping cylinder so as to act upon the damping piston (40).

3. An axial piston machine according to claim 2, wherein a further pressure fluid is additionally drawn via the throttle element (47).

4. An axial piston machine according to claim 2, wherein said restoring spring (43) retains the damping piston (40) in abutment against a stationary counter element (30) opposing the inclined plate (25).

5. An axial piston machine according to any one of claims 1 to 3, wherein said pressure fluid reservoir (48) is a leakage fluid collecting chamber.

6. An axial piston machine according to any one of claims 1 to 3, wherein said pressure fluid reservoir (48) comprises the interior (46) of a housing of the axial piston machine (1).

7. An axial piston machine according to claim 1, wherein said inclined plate (25) is reciprocatingly pivotable by said pivoting device (31) between a first pivoted position corresponding to a larger angle of inclination and a second pivoted position corresponding to a smaller angle of inclination, and said damping element (41) dampens the pivoting movement during the pivoting of the inclined plate (25) from the first into the second position.

8. An axial piston machine according to claim 7, wherein the inclined plate (25) on a side thereof facing away from the pistons (5, 6) comprises a first abutment surface and a second (29) abutment surface, whereby during abutment against the first abutment surface (28) the inclined plate assumes the first pivoted position at the larger angle of inclination and during abutment against the second abutment surface (29) assumes the second pivoted position at the smaller angle of inclination.

9. An axial piston machine according to claim 1, wherein a point in operation at which at least one said damping piston (40*a,* 40*b*) acts upon the inclined plate (25), is offset relative to the cylinder block axis (12) such that a resulting force, which is composed of a force ($F_{DR}$) exerted by the damping piston (40*a;* 40*b*) upon the inclined plate (25), a force ($F_V$) exerted by the pivoting device (31) against the inclined plate (25) during the pivoting movement and a force ($F_{KL}$) exerted by the pistons (5, 6) against the inclined plate (25), acts at a center of gravity of forces (S) which are located on the cylinder block axis (12).

* * * * *